US009812237B2

(12) United States Patent
Kapoor et al.

(10) Patent No.: US 9,812,237 B2
(45) Date of Patent: Nov. 7, 2017

(54) SOFT MAGNETIC CORE WITH POSITION-DEPENDENT PERMEABILITY

(71) Applicant: Vacuumschmelze GmbH & Co. KG, Hanau (DE)

(72) Inventors: Jivan Kapoor, Wiesbaden (DE); Christian Polak, Blankenbach (DE)

(73) Assignee: VACUUMSCHMELZE GMBH & CO. KG, Hanau (DE)

( * ) Notice: Subject to any disclaimer, the term of this patent is extended or adjusted under 35 U.S.C. 154(b) by 0 days.

(21) Appl. No.: 14/394,841

(22) PCT Filed: Apr. 12, 2013

(86) PCT No.: PCT/EP2013/057652
§ 371 (c)(1),
(2) Date: Oct. 16, 2014

(87) PCT Pub. No.: WO2013/156397
PCT Pub. Date: Oct. 24, 2013

(65) Prior Publication Data

US 2015/0070124 A1 Mar. 12, 2015

(30) Foreign Application Priority Data

Apr. 16, 2012 (DE) ..... 10 2012 206 225

(51) Int. Cl.
*H01F 27/28* (2006.01)
*H01F 3/00* (2006.01)
(Continued)

(52) U.S. Cl.
CPC ..... *H01F 3/00* (2013.01); *H01F 3/04* (2013.01); *H01F 3/08* (2013.01); *H01F 3/10* (2013.01);
(Continued)

(58) Field of Classification Search
CPC ..... H01F 27/00–27/30
(Continued)

(56) References Cited

U.S. PATENT DOCUMENTS 2,982,948 A 5/1961 Brownlow et al.
3,157,866 A * 11/1964 Lien ..... G11C 11/0605 336/233
(Continued)

FOREIGN PATENT DOCUMENTS

DE 975437 C 11/1961
DE 975437 C 11/1961
(Continued)

OTHER PUBLICATIONS

Yanai T et al: "Magnetic Properties of Fe-Based Ribbons and Toroidal Cores Prepared by Continuous Stress-Annealing by Joule Heating", Magnetics Conference, 2006, INTERMAG 2006. IEEE International, IEEE, PI, May 1, 2006 (May 1, 2006), pp. 51-51, XPO31183629, DOI: 10.1109/INTMAG.2006.37551 ISBN: 978-1-4244-1479-6 the whole document.
(Continued)

*Primary Examiner* — Tuyen Nguyen
(74) *Attorney, Agent, or Firm* — Dickinson Wright PLLC

(57) ABSTRACT

Soft magnetic core, in which permeabilities that occur at least two different locations of the core are different.

6 Claims, 16 Drawing Sheets

(51) Int. Cl.

| | |
|---|---|
| ***H01F 3/10*** | (2006.01) |
| ***H01F 17/06*** | (2006.01) |
| ***H01F 41/02*** | (2006.01) |
| ***H01F 3/04*** | (2006.01) |
| ***H01F 3/08*** | (2006.01) |
| *H01F 1/153* | (2006.01) |

(52) U.S. Cl.
CPC ..... *H01F 17/06* (2013.01); *H01F 27/28* (2013.01); *H01F 41/0213* (2013.01); *H01F 41/0246* (2013.01); *H01F 1/15333* (2013.01); *H01F 2003/106* (2013.01)

(58) Field of Classification Search
USPC ..... 336/212, 220–223, 233–234
See application file for complete search history.

(56) References Cited

U.S. PATENT DOCUMENTS 3,170,133 A * 2/1965 Kernick ..... H01F 30/16 336/165
3,315,087 A * 4/1967 Ingenito ..... H03K 3/30 336/233
3,454,916 A * 7/1969 Hoover ..... H01F 30/16 336/212
4,205,288 A * 5/1980 Lin ..... H01F 27/245 336/212
4,520,335 A * 5/1985 Rauch ..... H01F 27/245 336/212
4,565,746 A * 1/1986 Hayase ..... H01F 27/245 336/234
5,083,101 A * 1/1992 Frederick ..... H03H 1/0007 333/12
5,581,224 A * 12/1996 Yamaguchi ..... H01F 3/10 333/185
7,675,398 B2 * 3/2010 Endou ..... H01F 3/04 336/234
7,905,966 B2 3/2011 Waeckerle et al.
2007/0115087 A1 5/2007 Lee
2008/0196795 A1 8/2008 Waeckerle

FOREIGN PATENT DOCUMENTS

DE 2736963 A1 2/1979
JP 2004134681 A 4/2004
JP 2005093962 A 4/2005
JP 2007180135 A 7/2007
JP 2015515143 A 5/2015
KR 20080034841 A 4/2006

OTHER PUBLICATIONS

International Search Report for PCT/EP2013/057652 dated Jul. 24, 2013 and English translation.
Japanese Office Action dated Dec. 22, 2015.
Japanese Office Action dated Oct. 27, 2016.
Korean Office Action dated Oct. 28, 2016.

* cited by examiner

| | 13 | 14 | 16 | 15 |
|---|---|---|---|---|
| | CSC-MF μi=90 | CSC-HF μi=160 | VP μ=const | VP μ variable |
| Da (x Di=6 x h=25) | 31 | 20 | 17.4 | 17.4 |
| Core volume (ccm) | 18.2 | 7.2 | 5.2 | 5.2 |
| Used μ region for Imax | 20-79 | 18-122 | 66 | 66-191 |
| Bs (T) | 1.6 | 1.5 | 1.2 | 1.2 |
FIG 12
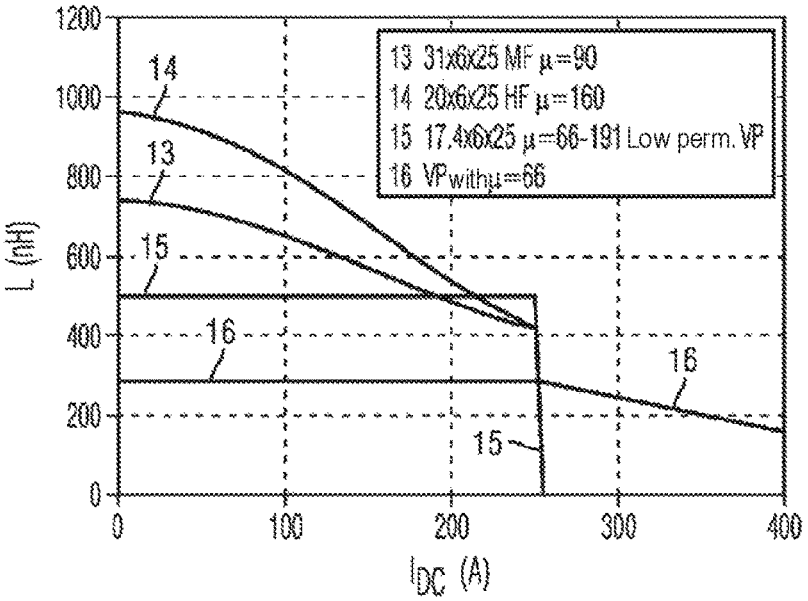
FIG 13
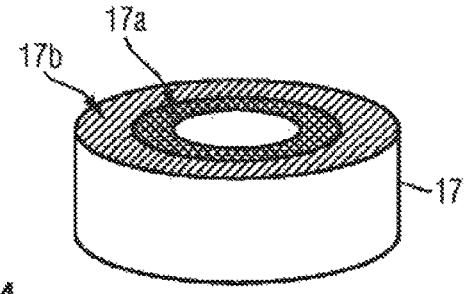
FIG 14

SOFT MAGNETIC CORE WITH POSITION-DEPENDENT PERMEABILITY

The invention relates to cores of soft magnetic material, for example for producing inductances.

In electronic control devices such as, for example, DC-DC converters, storage inductors, storage transformers or filter inductors with low-permeable core material are often used, for example, as inductive energy storage devices. In the cores of these inductive components, highly non-uniform field distributions can occur, depending on the design. In general, the core material is therefore not optimally saturated or used over the site. Even for relatively highly symmetrical annular core inductors, this is still noticeably the case, and for a larger inside-to-outside diameter ratio, this leads to less optimum designs since at a given volume, the maximum possible inductance is not reached or for given inductance, the smallest or most economical design is not achieved.

The aforementioned core saturation effects in currently conventional cores with a homogeneous permeability distribution likewise via partial saturation effects lead to effective core permeabilities that are dependent upon the degree of saturation. This is accompanied by noticeable degradation of component properties, such as, for example, the increase of the measurement error in current converters. They can only be caught at present by a corresponding overdimensioning of the core, which avoids operation in the widened transition region into saturation; this in turn raises costs.

The object of the invention is to make available soft magnetic cores that compared to known cores at the same volume have better properties or for the same properties have a smaller volume.

The object is achieved by a soft magnetic core in which permeabilities that occur at at least two different locations on the core are different.

The expression "different permeabilities" is defined as the difference of two permeabilities being greater than the differences that are caused by production tolerances and measurement inaccuracies. Thus, for example, the ratio between the minimum and maximum permeability that occurs can be greater than 1:1.1 or 1:1.2 or 1:1.5 or 1:2 or 1:3 or 1:5.

The invention is presented in more detail below using the embodiments that are shown in the figures of the drawing. Here:

FIG. 1 schematically shows a soft magnetic annular core with a conductor routed through the annular core opening;

FIG. 12 shows in a table the parameters of the arrangement that is shown in FIG. 1 for four different cases;

FIG. 13 shows in a diagram the characteristic of the inductance as a function of the direct current through the conductor of the arrangement that is shown in FIG. 1 for the cases that are shown in conjunction with FIG. 12;

Figure 1:
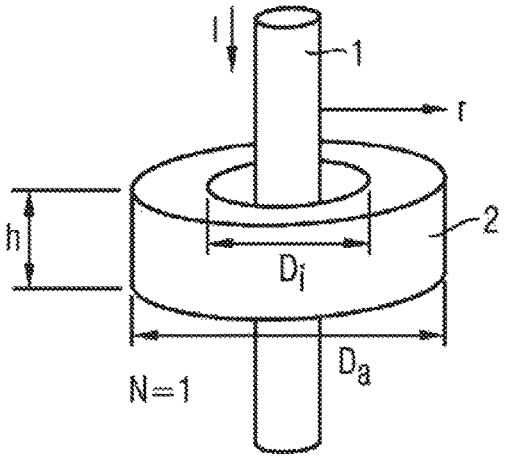
Figure 15:
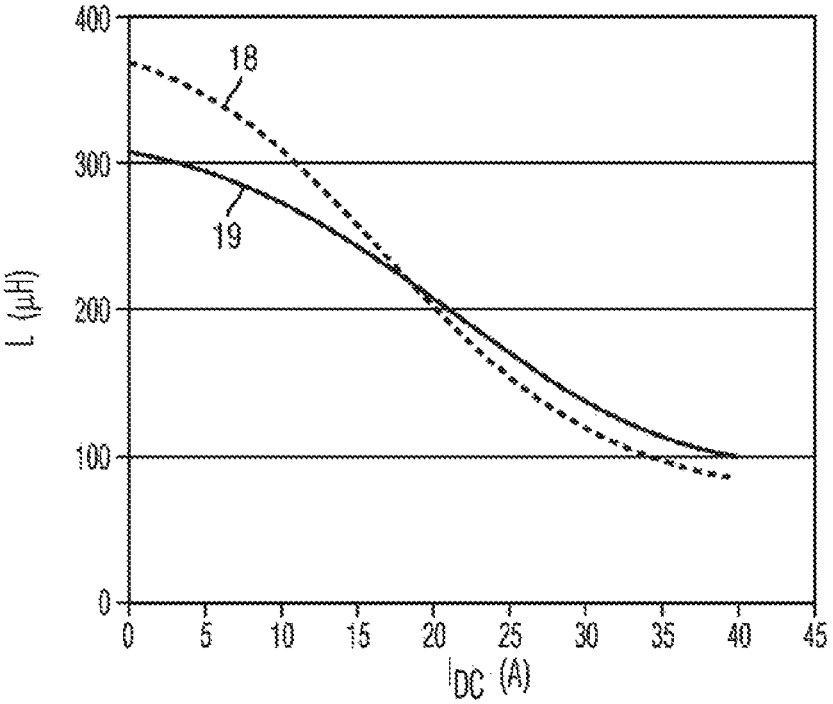
Figure 16:
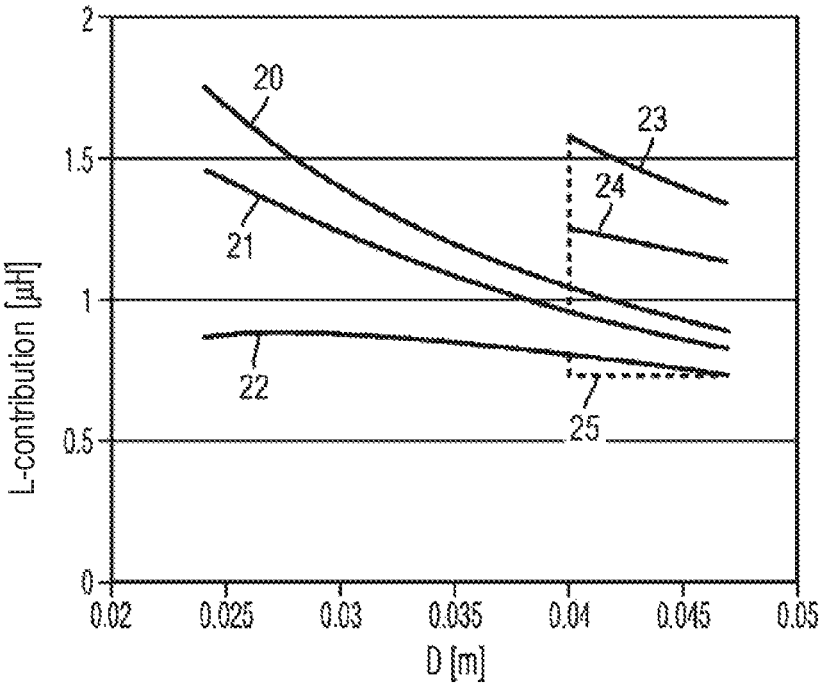
Figure 17:
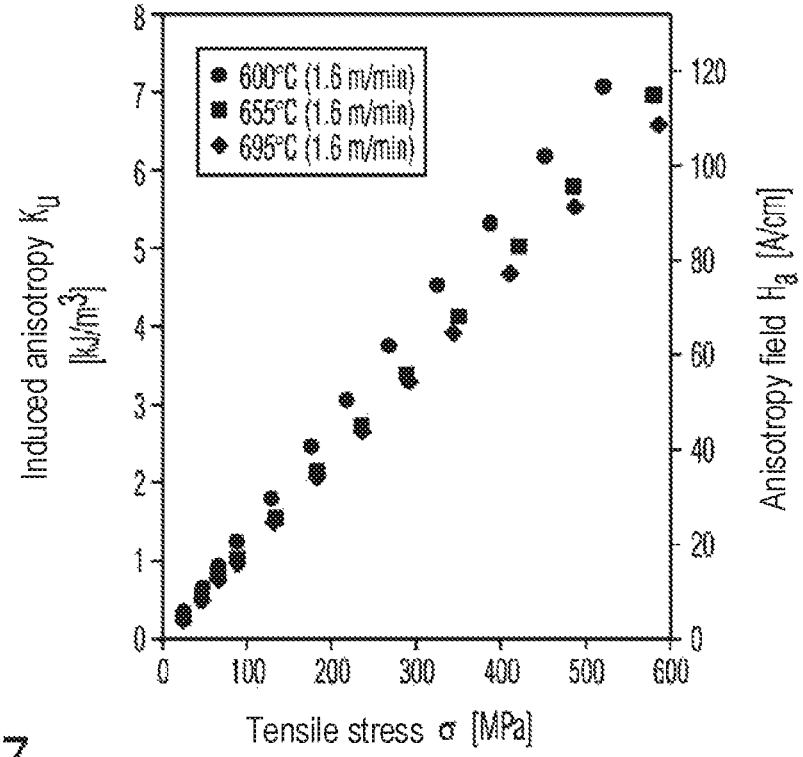
Figure 18:
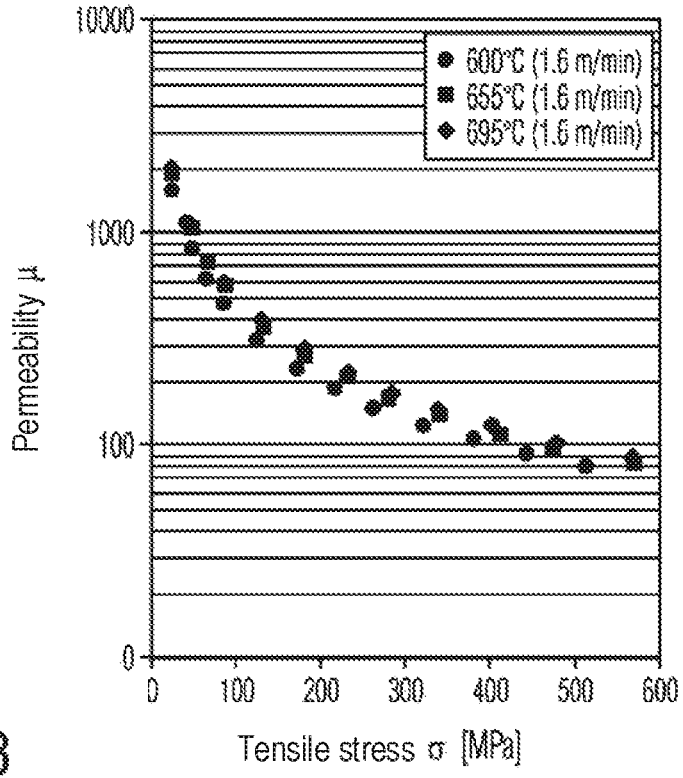
Figure 19:
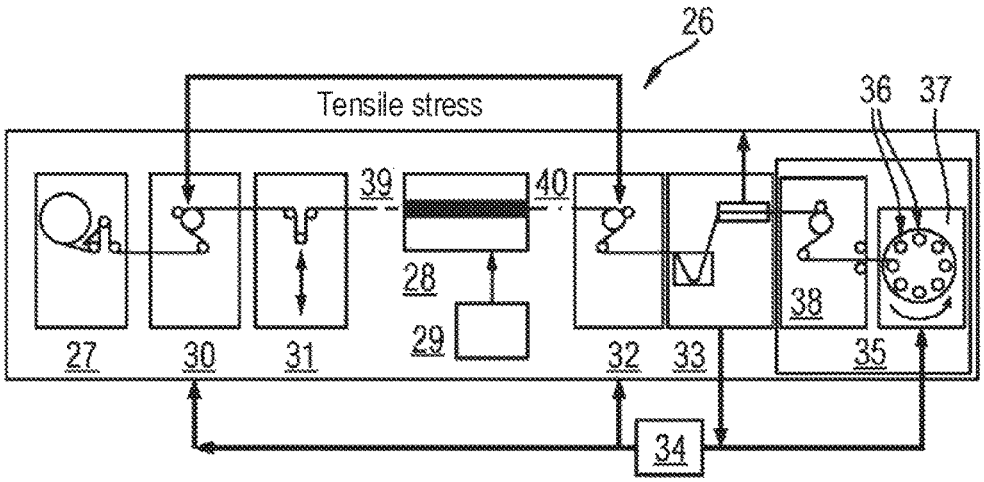
Figure 20:
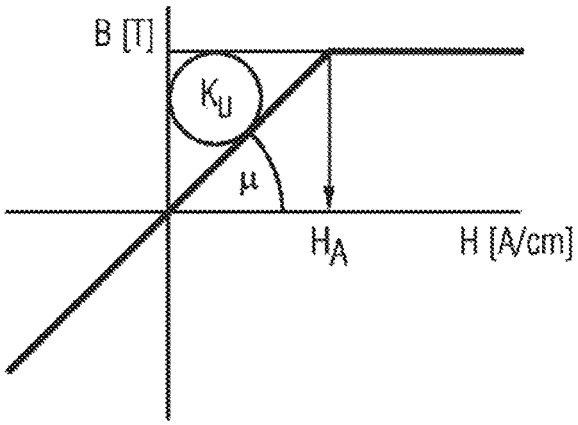
Figure 21:
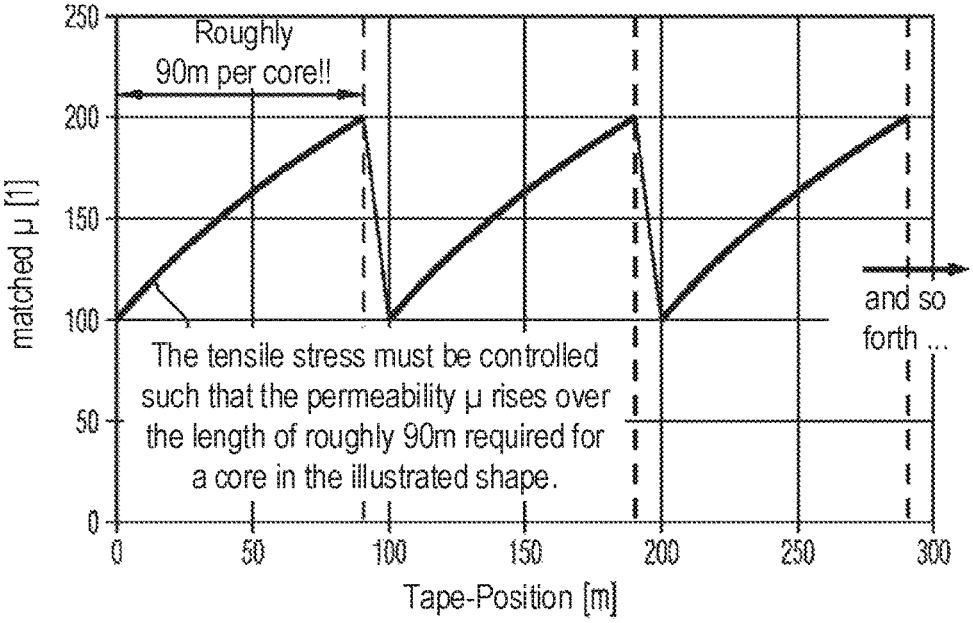
Figure 22:
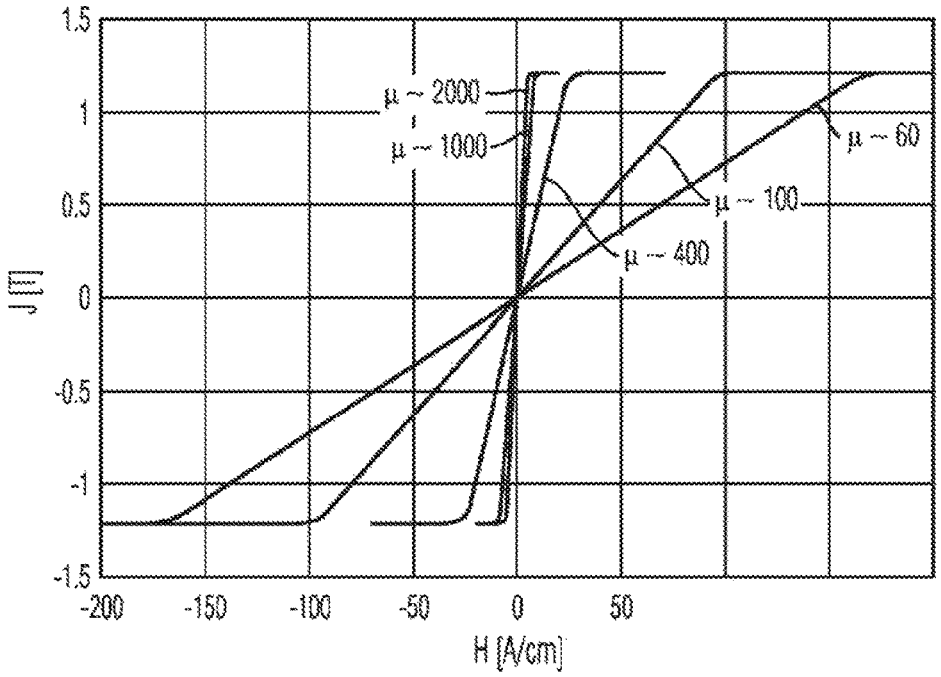
Figure 23:
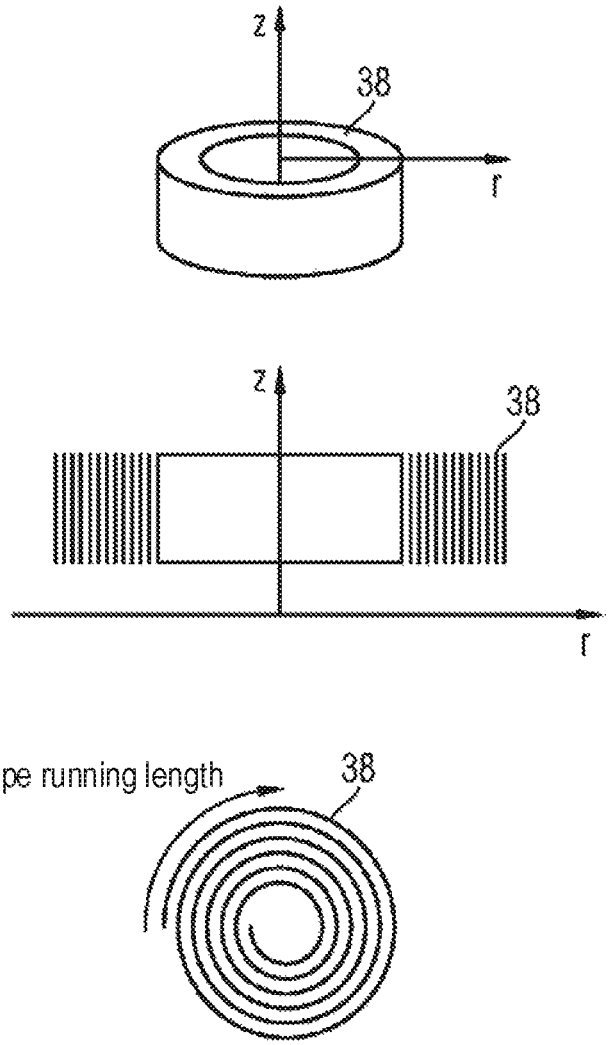
Figure 24:
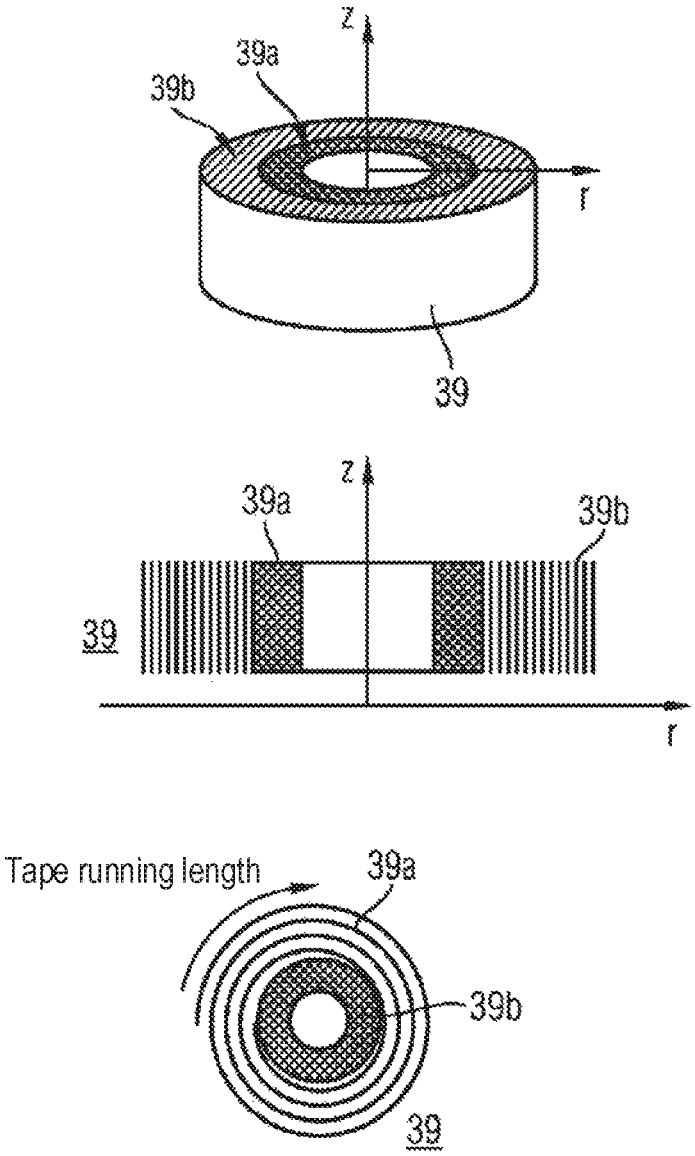
Figure 25:
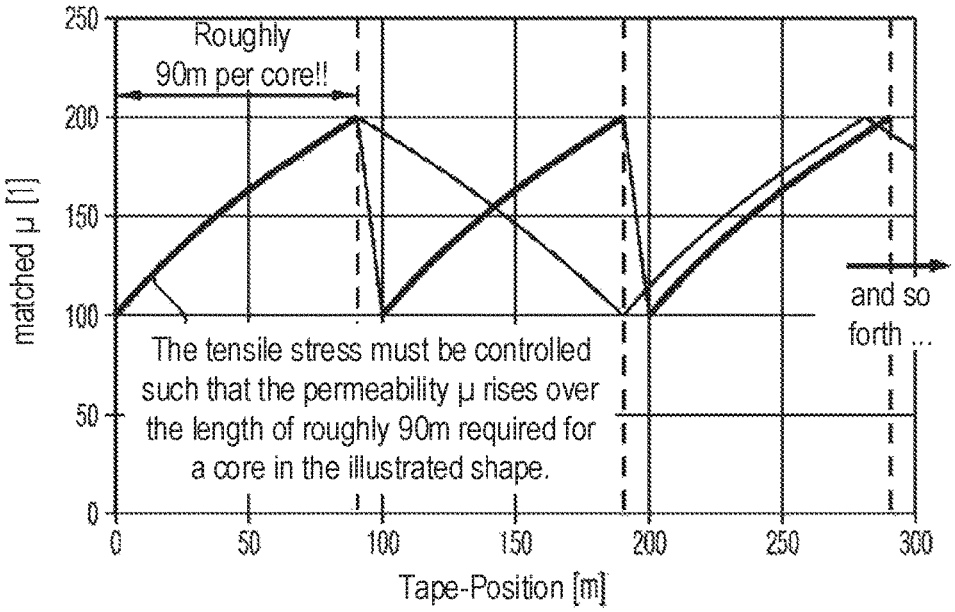
Figure 26:
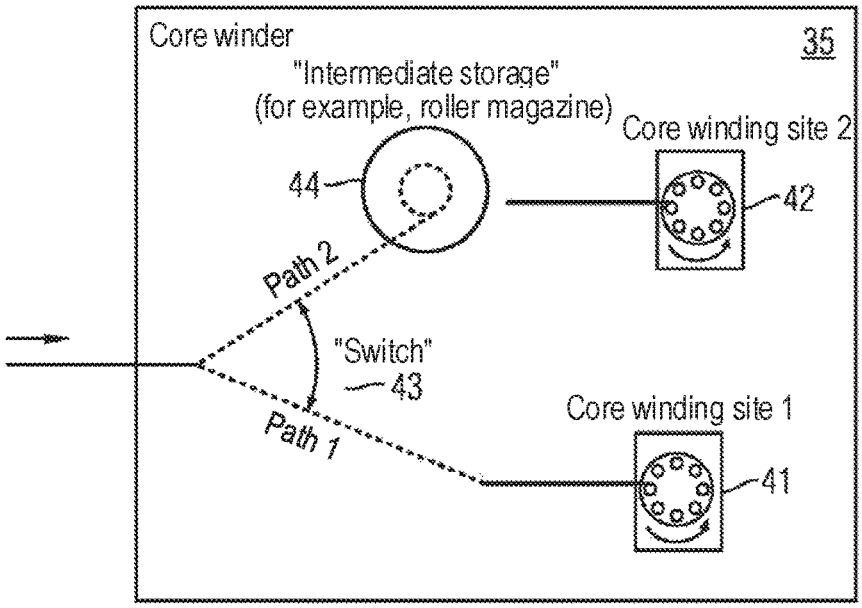
Figure 27:
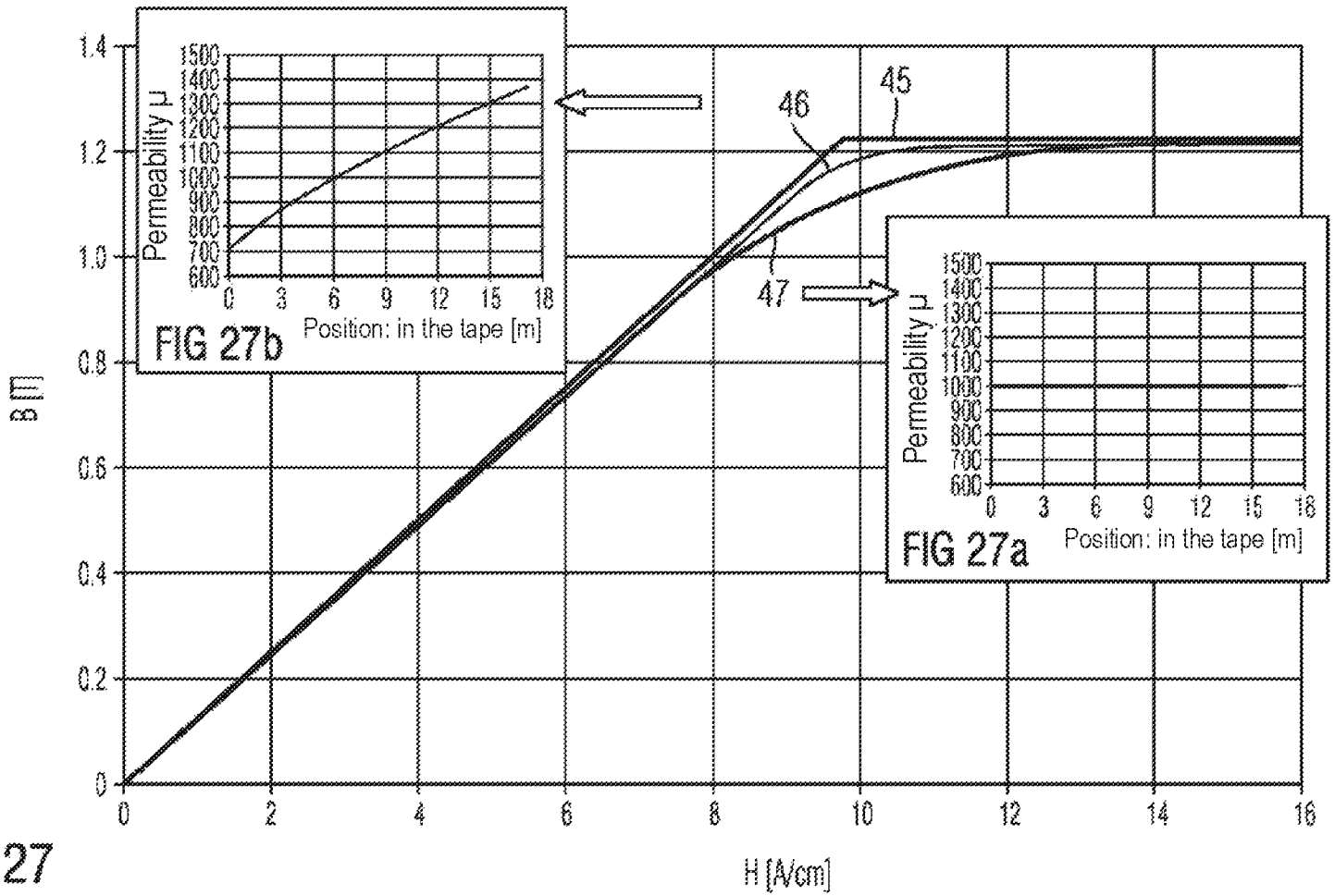
Figure 28:
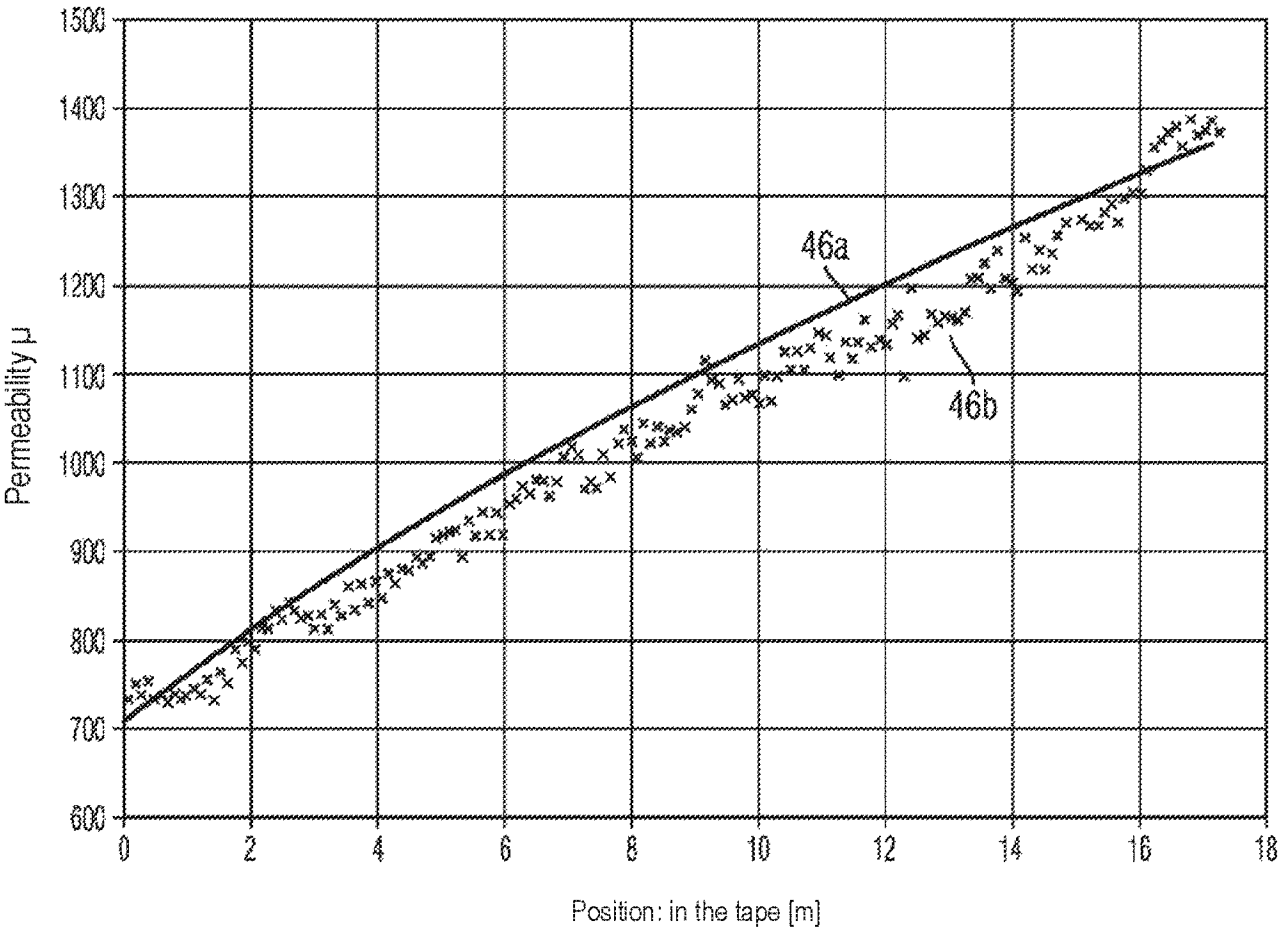

FIG. 14 schematically shows the structure of a two-part core with a staggered permeability characteristic;

FIG. 15 shows in a diagram the inductance as a function of the direct current through the conductor of the arrangement that is shown in FIG. 1 when using a two-piece core compared to a one-piece core;

FIG. 16 shows in a diagram the inductance contribution over the average diameter for one-piece and two-piece cores at different current strengths;

FIG. 17 shows in a diagram the induced anisotropy over the tensile stress for different heat treatments;

FIG. 18 shows in a diagram the permeability as a function of the tensile stress for different heat treatments;

FIG. 19 shows in a block diagram an arrangement for producing a core with a variable core permeability;

FIG. 20 shows the characteristic of the permeability over the field intensity for a core that has been produced with the arrangement according to FIG. 19;

FIG. 21 shows in a diagram the characteristic of the core permeability as a function of the tape position in a method for producing a tape with a permeability that changes over the length of the tape;

FIG. 22 shows in a diagram the magnetization over the field intensity for different annular tape-wound cores of nanocrystalline material with tensile stress-induced anisotropy;

FIG. 23 schematically shows the structure of a one-piece wound core with a permeability that varies over the radius;

FIG. 24 schematically shows the structure of a two-piece core with pressed and wound core parts;

FIG. 25 shows in a diagram the characteristic of the core permeability as a function of the tape position in a method alternative to the method shown in FIG. 21 for producing a tape with a permeability that changes over the length of the tape;

FIG. 26 shows in a schematic sketch a winding arrangement for use in the method shown in FIG. 25;

FIG. 27 shows in a diagram the magnetic flux as a function of the magnetic field intensity for a sample gradient core; and FIG. 28 shows in a diagram the characteristic of the permeability and the core field intensity over the tape position.

This invention makes it possible to prepare designs optimized for the respective application via locally-dependent permeability adaptation of a magnetic core of any shape and thus to enable, for example, volume-reduced or more economical cores. Depending on the geometry of the cores, for example as in annular cores, in the ideal case, some 10% inductance increase at the same core volume can thus be achieved. This is associated with the fact that these cores have a much sharper transition from the linear hysteresis range into saturation or an increased saturation range with constant or less strongly varying permeability. Here, it also becomes possible to set effective hysteresis forms that have been rounded in a dedicated manner by corresponding controlled deviations from the ideal case. This is achieved by the location dependency of the core permeability being matched to the non-uniform field distributions resulting from the geometrical shape of the component. Thus, saturation effects that start non-uniformly over the core volume are minimized or even avoided. Depending on the core material and core shape used, this is achieved in different ways. Conventional core shapes are, for example, annular, U-shaped, I-shaped or the like.

For annular cores, the magnetic field intensity H decreases inversely with the radius r so that $$H=N\cdot I/(2\pi r)$$

with N being the number of turns of a conductor routed through the core opening and I being the current strength of the current that is flowing through this conductor. This arrangement is shown in FIG. 1, a conductor 1 with a number of turns N=1 being routed through the opening of an annular core 2. The core 2 has an inside diameter $D_i$ that defines the opening, an outside diameter $D_a$, and a height h. The aforementioned field intensity drop leads to a homogeneous magnetic core material being saturated to the outside less and less dramatically on its material-typical, field intensity-dependent flux curve, also known as a B(H) curve (magnetic flux density B, field intensity H). Roughly simplified, therefore, the inner regions of the core can work already near or in saturation, therefore with correspondingly reduced action, while the outer regions are only weakly saturated. This effect is all the more pronounced, the greater the ratio of the outside diameter to the inside diameter. In a good approximation, it applies to, for example, height $h\rightarrow\infty$ or $$\phi=\int(1/2\pi r)\cdot\mu_0\cdot\mu(r)\cdot I)\cdot h\cdot dr$$

in the case of constant permeability:

$$L=\phi/I=(\mu_0\mu h)/2\pi)\cdot\ln(D_a/D_i)$$

in the case of a radial-linear permeability increase:

$$L=\phi/I=(\mu_0\mu_i h/2\pi)\cdot(D_a/D_i-1),\ \text{whereby}\ \mu(r)=(\mu_i/D_i)\cdot r.$$

Here, Φ is the magnetic flux, $\mu_0$ is the magnetic field constant, μ is the permeability, $\mu_i$ is the permeability on the inside diameter $D_i$, and μ(r) is for the radial-linear permeability increase.

The depicted problem can be resolved by the permeability of the core material being made to increase to the outside. Thus, the energy density in the core layers that are radially farther to the outside and thus their inductance contribution can be distinctly increased.

Figure 2:
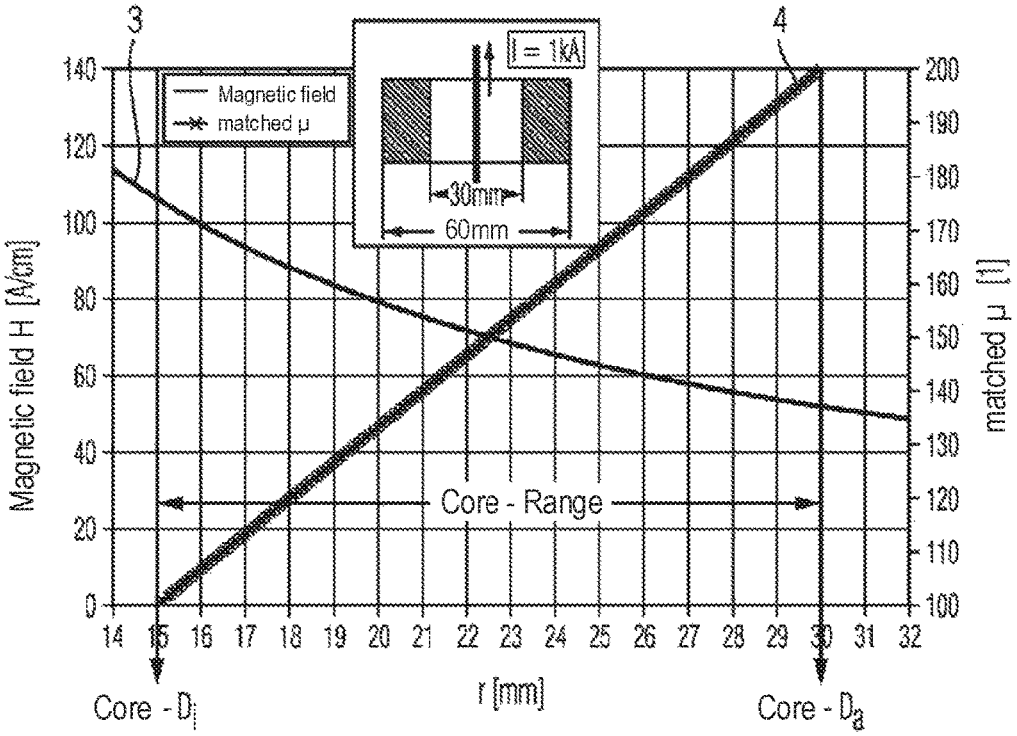
FIG. 2 shows in a diagram the characteristic of the field intensity and the radial-linear permeability increase over the core radius.

As a function of the radius r for a core with an inside diameter $D_i$=30 mm and an outside diameter $D_a$=60 mm, in this respect FIG. 2 shows, on the one hand, the characteristic of the magnetic field as a magnetic field intensity H over the radius r (curve 3) [and] a possible matching of the permeability μ (curve 4). As curve 3 shows, dramatically different field intensities H are active in the radial direction. The magnetic material is accordingly saturated to different degrees. With a correspondingly opposed characteristic of the permeability the field intensities H that are active differently in the radial direction can be compensated. Relative to the locally valid B(H) curve, at this point all core regions are similarly triggered, and altogether an optimized current-dependent inductance saturation curve results, such as, for example, the L(Idc) saturation curve (inductance L as a function of the direct current $I_{DC}$ that is flowing through it) of an inductor, i.e., with increased inductance values at small degrees of saturation and minimized, often unused inductance values for degrees of saturation over the required operating range.

Figure 3:
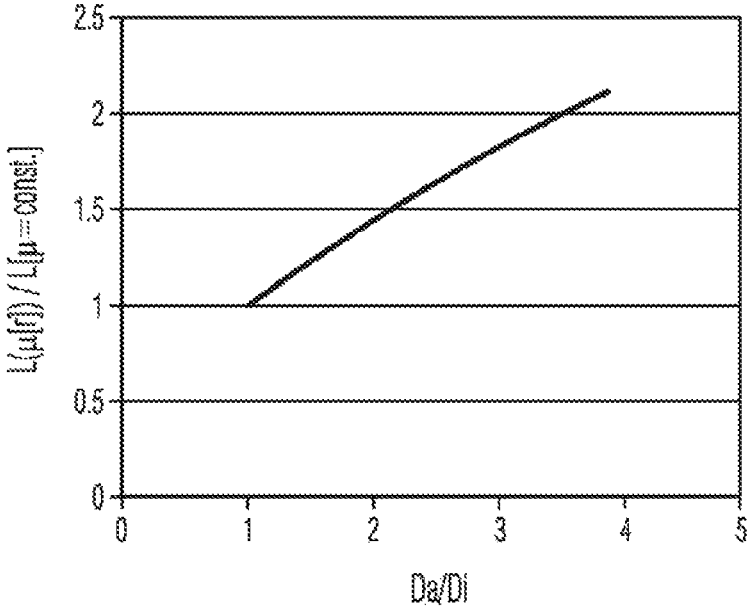
FIG. 3 shows in a diagram the relative inductance increase for a radial-linear permeability increase compared to a constant permeability characteristic.

FIG. 3 shows in this respect the relative inductance increase for a radial-linear permeability increase compared to a constant permeability as a function of the ratio of the outside diameter $D_a$ to the inside diameter $D_i$. This indicates that for small $D_a/D_i$ ratios, only a moderate advantage of up to roughly 30% for typical cores occurs. A major potential arises, however, for cores in which the ratios are larger (beginning from $D_a/D_i>2$).

Figure 4:
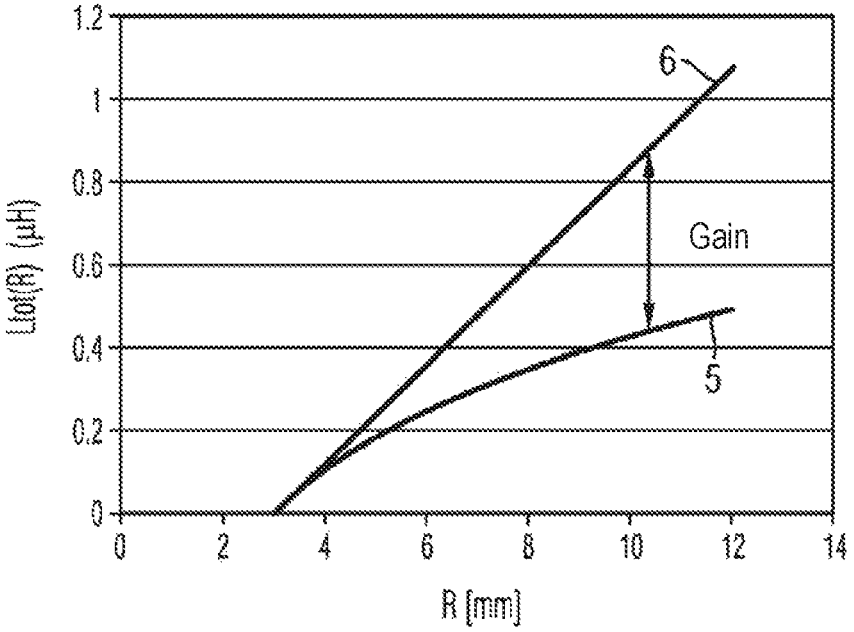
FIG. 4 shows in a diagram the radial dependency of the inductance contribution in the core.

FIG. 4 shows the gain in total inductance depending on the radius r, i.e., the difference between a core with radially-linearly increasing permeability μ(r) and a core with constant permeability $\mu=\mu_{max}(D_i)$. The example that is explained in conjunction with FIG. 4 was based on a core in which the outside diameter was $D_a$=24 mm, the inside diameter was $D_i$=6 mm, the height was h=20 mm, and the saturation flux was $B_S$=1.2T. As can be taken solely qualitatively from FIG. 4, the gain clearly increases with increasing radius.

Figure 5:
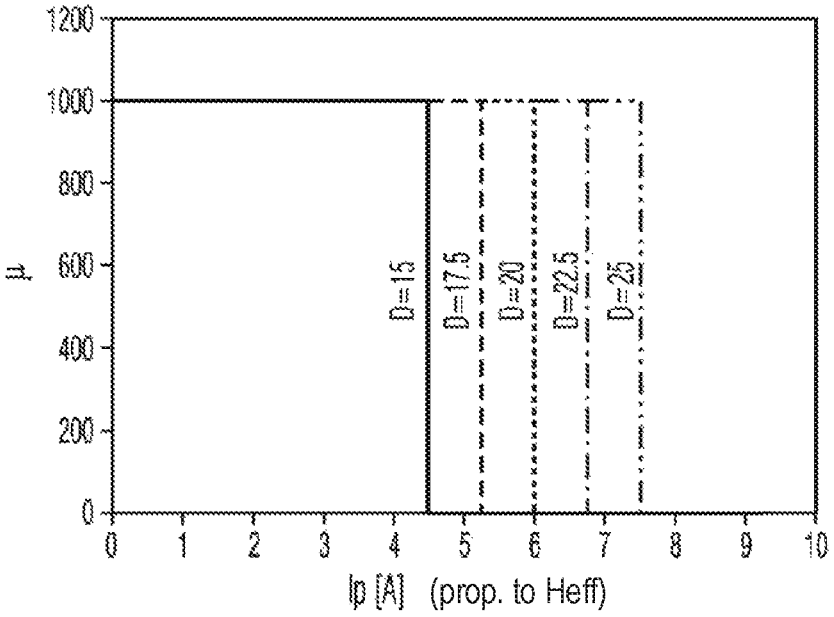
FIG. 5 shows in a diagram the permeability over the current that generates an effective field intensity for a first case example.
Figure 6:
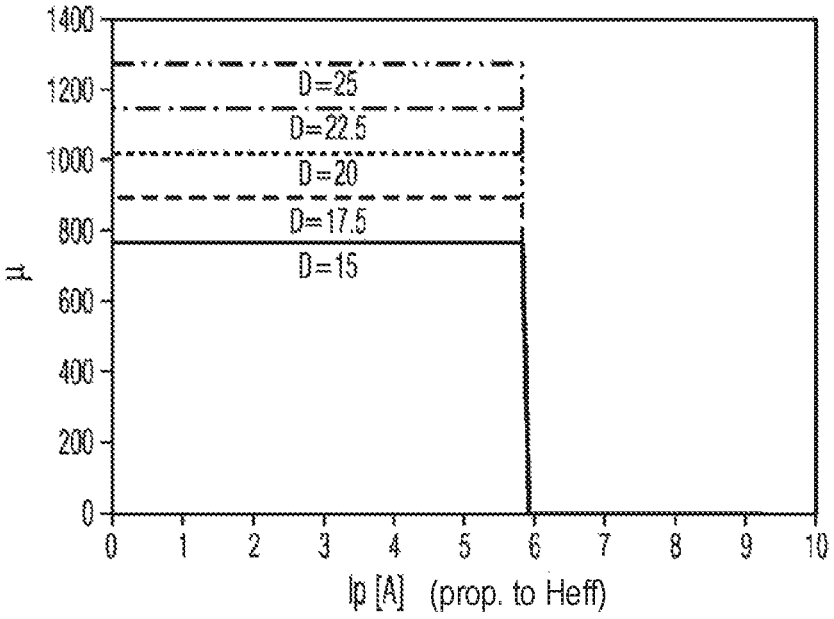
FIG. 6 shows in a diagram the permeability over the current that generates an effective field intensity for a second case example.

The effects of the 1/r field intensity saturation for a tape-wound core with an outside diameter $D_a$=25 mm, an inside diameter $D_i$=15 mm, and a height h=10 mm are shown in FIGS. 5 and 6. Here, the permeability μ, active in the core, is given as a function of the degree of core saturation $I_{DC}$ prop. $H_{DC,eff}$ resolved by different core regions or core shells of diameter D. FIG. 5 shows the case here in which the permeability μ=1000 for a field intensity H is smaller than or equal to a saturation field intensity $H_{SAT}$ and which otherwise is 1. For different diameters D of the core shells, for example with values of between D=15 and D=25, a clear fanning of the beginning of saturation over the core appears. FIG. 6 shows the case in which the permeability μ is dependent on the radius r for different core shell diameters D=15 . . . 25 mm. This shows that an optimal radial permeability dependency leads to a uniform transition into saturation.

Figure 7:
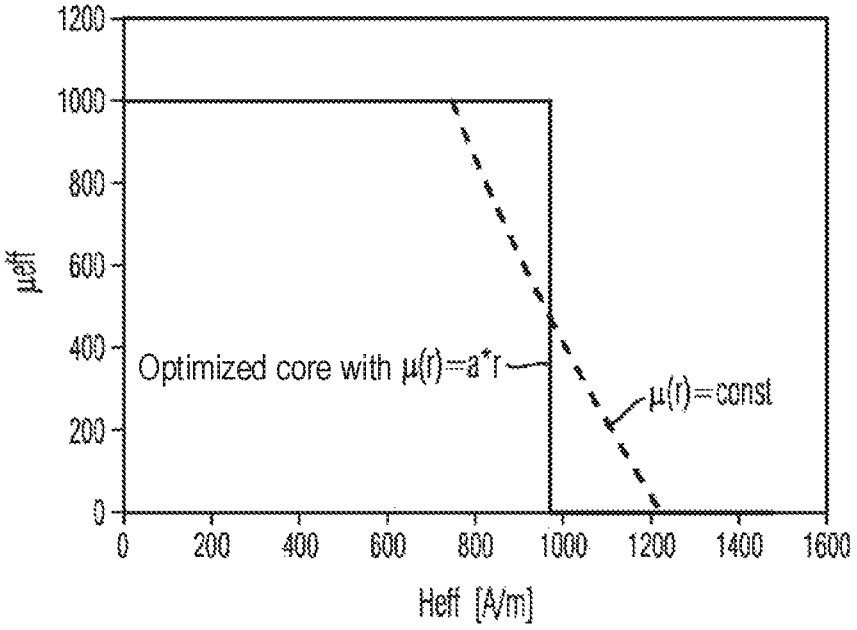
FIG. 7 shows in a diagram the effective permeability over the effective field intensity for the case shown in FIG. 5.
Figure 8:
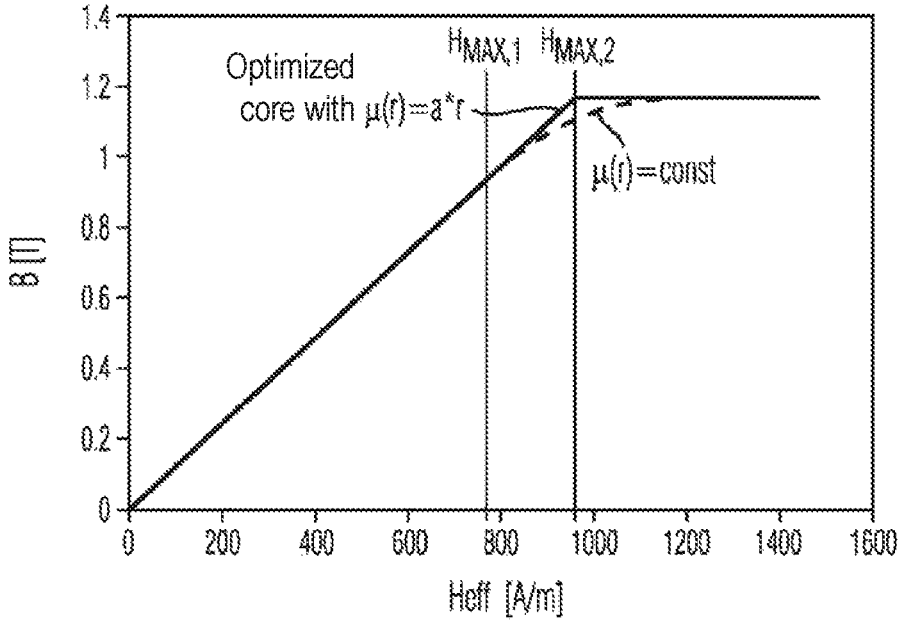
FIG. 8 shows in a diagram the magnetic flux over the effective field intensity for the case shown in FIG. 6.

FIGS. 7 and 8 shows the $\mu_{eff}(H_{DC})$ characteristics and the $L(I_{DC})$ characteristics, i.e., the effective permeability $\mu_{eff}$ and the L(Idc) saturation curve (inductance L as a function of the direct current $I_{DC}$ that is flowing through it) for the tape-wound cores used in conjunction with the embodiments according to FIGS. 5 and 6. In this case, FIG. 7 shows in turn the case μ=1000 for $H\leq H_{SAT}$ and otherwise 1, $H_{SAT}$ being the saturation field intensity. FIG. 8 relates to the case μ(r)=a·r, a being a constant proportionality factor. In FIG. 7, in this respect, the effective permeability $\mu_{eff}$ is plotted over the effective field intensity $H_{eff}$, and in the diagram shown in FIG. 8, the flux density B is plotted over the effective field intensity $H_{eff}$. It can be immediately recognized from FIGS. 7 and 8 that a clearly broadened transition into saturation for a core with constant permeability occurs. With radially-linearly increasing permeability, conversely, on the one hand, a uniform inductance for clearly higher fields (inductor currents) can be made available, and the region with constant permeability can be distinctly enlarged, as is advantageous, for example, in current sensor applications.

Figure 9:
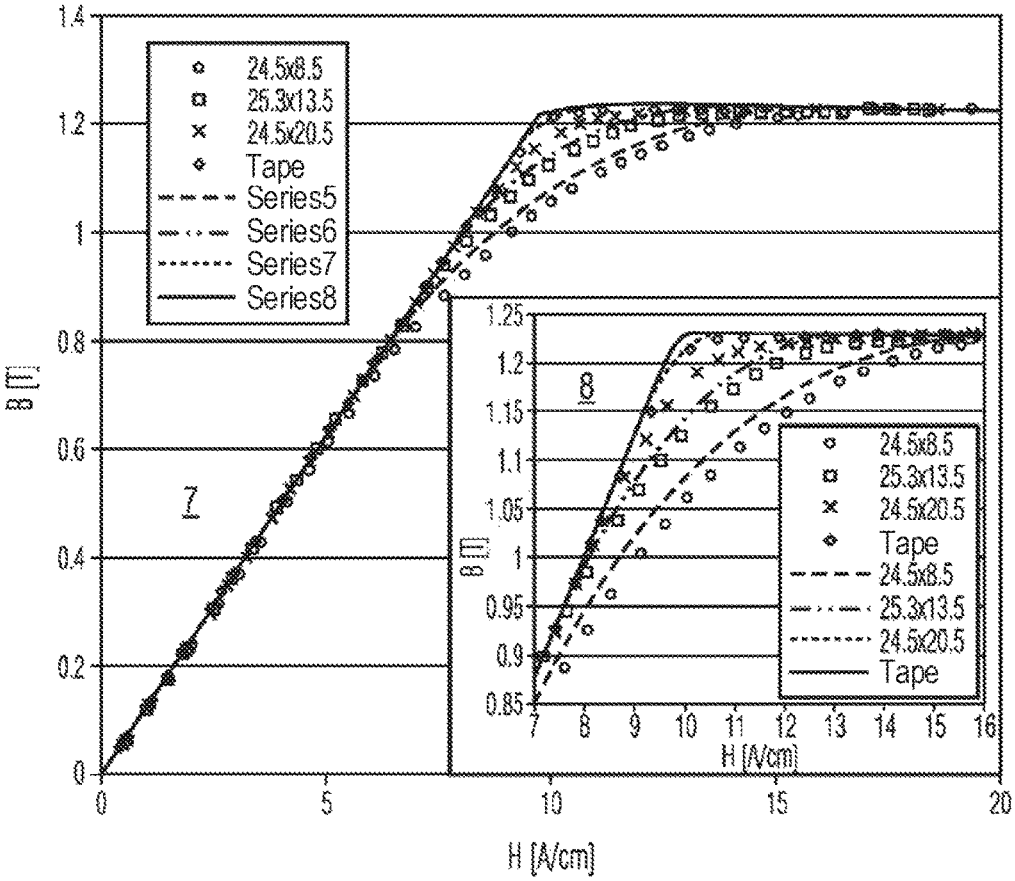
FIG. 9 shows in a diagram sample measurements of the geometry-dependent rounding of the flux-field intensity loop for cores with constant permeability for different outside and inside diameters.

In a diagram, FIG. 9 shows one example for a geometry-dependent rounding of the B(H) loop for cores with constant permeability μ for different outside and inside diameters. As is apparent therefrom, the experimental observations whose pertinent measuring points are shown with the symbols O, □, and x for 3 different outside and inside diameter ratios (curve 7) with good agreement confirm the model predictions shown by broken lines for the 3 different outside and inside diameter ratios. The inserted image in FIG. 9 shows as curves 8 an enlargement of the ratios in the region of the kink to the magnetic saturation in curves 7.

Figure 10:
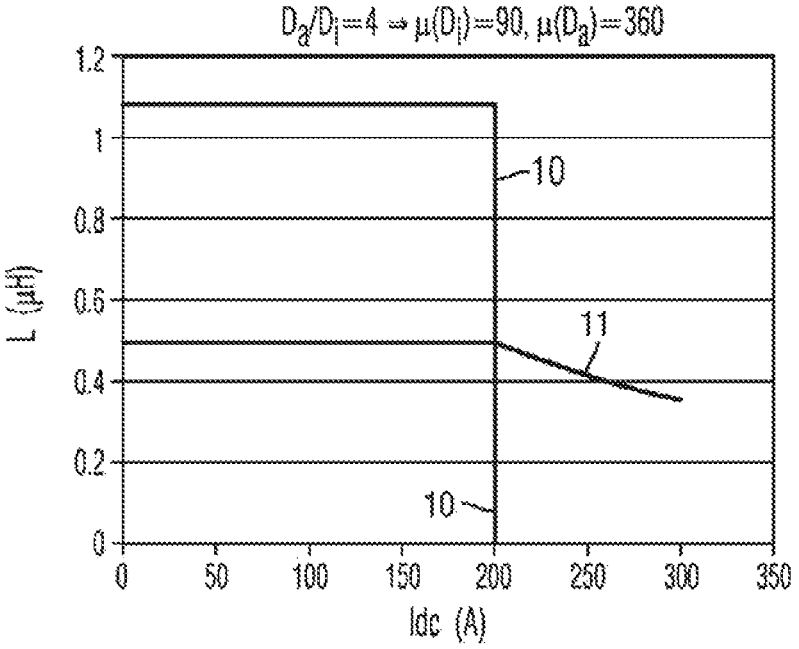
FIG. 10 shows in a diagram the characteristic of the inductance as a function of the direct current through the conductor for the arrangement that is shown in FIG. 1 for a first dimensioning.
Figure 11:
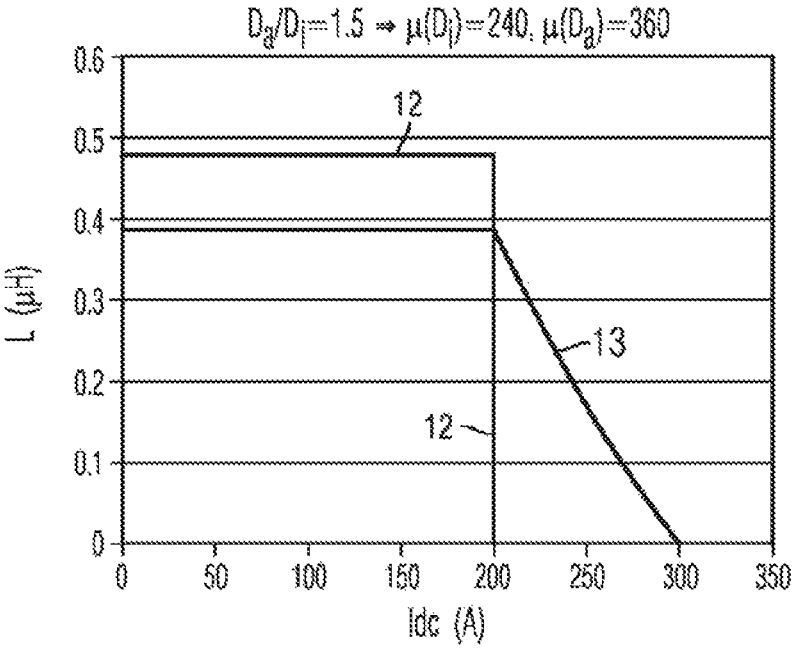
FIG. 11 shows in a diagram the characteristic of the inductance as a function of the direct current through the conductor in the arrangement that is shown in FIG. 1 for a second dimensioning.

FIGS. 10 and 11 show a further example for the current-dependent inductance characteristic ($L(I_{DC})$ characteristic), a core with an outside diameter $D_a$=24 mm, a height h=20 mm, and a saturation flux $B_S$ 1.2T at a number of turns N=1 having been assumed. The object here is to keep the inductance value L constant for currents $I_{DC}$ up to roughly 200 A.

In this case, FIG. 10 shows the case in which the inside diameter $D_i$=6 mm and thus $D_a/D_i$=4. The permeability $\mu_i=\mu(D_i)$ for the inside diameter $D_i$ is 90, and the permeability $\mu_a=\mu(D_a)$ on the outside diameter $D_a$ is 360. Here, in turn, it is differentiated between a core with a constant permeability characteristic (curve 10) and a core with a matched permeability characteristic (curve 11). The inside diameter $D_i$ in this case is 6 mm.

In the diagram shown in FIG. 11, it is also differentiated between a core with a constant permeability characteristic (curve 11) and a core with a variable permeability characteristic (curve 12), here in each case an inside core diameter of $D_i$=16 mm being used. Thus, here a $D_a/D_i$ ratio of 1.5 with a permeability $\mu_i=\mu(D_i)$ on the inside diameter $D_i$ of 240 and a permeability $\mu_a=\mu(D_a)$ on the outside diameter $D_a$ of 360 is produced.

In the table shown in FIG. 12, four cores are compared, all cores having an inside diameter of $D_i$=6 mm and a height h=25 mm. Here, it is a CSF-MF core 13 with a permeability $\mu=\mu_i$=90 that is constant over the radius, a CSF-HF core 14 with a permeability $\mu=\mu_i$=160 that is constant over the radius r, a core VP with a permeability $\mu=\mu_i$=66 that is constant over the radius r, and a core VP with variable permeability $\mu=\mu(r)$ between 66 and 191. For the individual cores, the table contains the respective outside diameter $D_a$, the respective core volume, the permeability range used at the time for maximum current $I_{max}$ and the saturation flux density $B_s$. The cores should be used, for example, to produce filter inductors with one turn whose desired inductance values at a direct current 500 mH and at 250 A should be >350 mH. FIG. 13 shows the characteristic of the inductance L over the (direct) current $I_{DC}$ that is flowing through the inductor. As is apparent therefrom, in spite of lower saturation magnetization $B_S$, the specification with low-permeable VP with smaller volume can be easily satisfied (compare curves to cores 13 to 16).

FIG. 14 shows a core that has different permeabilities in areas. The core 17 shown there is made in two parts such that two annular ring parts 17*a* and 17*b* are fitted concentrically into one another. Each of the two core parts 17*a* and 17*b* inherently has a homogenous permeability distribution, but the permeabilities are different relative to one another, i.e., the inner core part 17*a* has a lower permeability than the outer core part 17*b*. In this case, the two core parts 17*a* and 17*b* are powder cores, but the two cores can be produced differently in any way (compare also FIG. 24 and the pertinent description).

In FIG. 15, the inductance characteristics of an optimized two-piece core (curve 18) that is shown in FIG. 14 and a conventional one-piece core (curve 19) are placed opposite one another. In this case, the illustrated curves 18 and 19 rest on an FeSi powder core with an outside diameter $D_a$=47 mm, an inside diameter $D_i$=24 mm, and a height h=18 mm. The permeability $\mu_{ia}$ on the inside diameter of the core part 17*a* is 60, and the permeability $\mu_{ib}$ on the inside diameter of the core part 17*b* is 90. FIG. 16 shows the inductance contributions over the core diameter for one-piece and two-piece cores at currents of 0 A, 10 A, and 20 A as curves 20 to 25. The superiority of the cores with radially changing permeability is also immediately apparent therefrom.

Instead of a multi-piece magnetic core with incrementally changing permeability as shown in FIG. 14, a powder core with continuously changing permeability can also be produced in which materials of different permeability are layered into a mold or two materials each with constant permeability that is, however, different between one another (especially one of the materials with μ=0) with mixing ratios that are different in the radial direction are mixed. Moreover, it is also possible, however, to attain a core with continuously changing permeability by winding a tape with a permeability that changes over the length. A tape with a permeability that changes over the length can be produced, for example, using tensile stress-induced anisotropy. In tape-wound cores, by using a continuous heat treatment of the tape under tensile stress, a permeability profile μ(l) that can be varied in wide limits can be very exactly established along the direction l in which the tape runs. In particular, the permeability profile can be chosen such that when the tape is being wound, the desired radially increasing μ(r) function is established on the finished core. In a coupled "in-line" core production, the core winding can directly follow the heat treatment of the tape (tape temperature treatment) under tension and thus can be actively adjusted to the current, radially dependent permeability requirement by tension adjustment. Alternatively, core winding from tapes with different constant permeabilities that has been completely decoupled from the tape production can also be carried out. Accordingly, automated winding machines can draw tapes with different permeabilities from different magazines and successively process them. According to these methods, however, only staggered and not radially continuous variations in the core can be produced.

FIG. 17 shows the characteristic of induced anisotropy $K_u$ over the tensile stress σ for different heat treatments. FIG. 18 shows the pertinent permeability characteristic μ over the tensile stress σ. Accordingly, the permeability in this case is a function of the vacuum permeability $\mu_0$ of the tape, its induced anisotropy $K_u$, and the saturation flux density $B_S$ as follows:

$$\mu=0.5\cdot B_s^2/(\mu_0 K_u).$$

FIG. 19 schematically shows a device 26 for producing soft magnetic strip material. The latter comprises an input-side material feed 27 for making available tape-shaped material 39, a heat treatment device 28 for heat treatment of the tape-shaped material 39 that has been supplied to it for producing a heat-treated tape material 40, a tension device 30, 31, 32, 33 that is made to feed a tensile force into the tape-shaped material 39, and a tensile stress in the direction of the longitudinal axis of its tape at least in the region of the heat treatment device 28. The tension device 30, 31, 32, 33 is made controllable for purposes of varying the tensile force.

The device 26, moreover, comprises a measurement arrangement 33 for determining the permeability of the produced soft magnetic strip material 40 and a control unit 34 for controlling the tensioning device 30, 31, 32, the control unit 32 being made and coupled to the measurement arrangement 31 such that the tensioning device 30 controls the tensile force in a reaction to the established permeability μ compared to a given (desired) reference value. In the illustrated configuration, the tensioning device 30, 31, 32 comprises two S-shaped roller drives 30, 32 that are coupled to one another, and a dancer roll control 31. In this case, the speeds of the roller drives 30 and 32 are controlled, i.e., adjusted by the control unit 34, such that the desired tensile stress builds up as a function of the permeability that has been ascertained by the measurement arrangement 33 in the tape material 39 (and 40). The dancer roll control 31 is used to equalize brief speed fluctuations.

In addition, the device 26 can have a magnetic field generator 29 that produces at least one magnetic field for magnetic field treatment of the heat-treated tape material, such as, for example, a magnetic field perpendicular to the direction in which the tape is running, also known as a transverse field. Likewise, a winding unit 35 with several winding mandrels 36 can optionally [sic] on a rotatable turret plate 37 for winding up one defined segment of the produced tape material 40 at a time. In this case, the winding unit 35 can have an additional S-shaped roller drive 38 that feeds the treated tape material, therefore the strip material 40, to the respective winding mandrel 36.

FIG. 20 shows the relationship between a tensile stress that has been fed into the tape-shaped material 39 by means of a tensile force F and the anisotropy $K_u$ and permeability μ that result therefrom. A tensile stress σ that occurs locally in the tape-shaped material 39 in this case results from the prevailing tensile force F and a local magnetic cross-sectional area $A_{Fe}$ (material cross-section) to be the following:

$$\sigma=F/A_{Fe},$$

so that an induced anisotropy $K_u$ in the transverse direction to the tape-shaped material 39 that has been extended lengthwise rises as a function of the tensile stress σ. The permeability μ is adjusted via the generated tensile stress σ and results from the average rise of the hysteresis loop or from the saturation flux density $B_S$ or the magnetic field intensity H, specifically the anisotropy field intensity $H_A$ as well as the magnetic field constant $\mu_0$ in conjunction with the anisotropy $K_u$ as explained above in conjunction with FIG. 17.

If, therefore, for example, there is a fluctuating thickness of the tape-shaped material as a result of production, when a uniform width is assumed, the local cross-sectional area $A_{Fe}$ and with it at constant tensile force F the prevailing tensile stress σ fluctuate accordingly. This in turn causes a corresponding change of the induced anisotropy $K_u$ that via the indicated relationships influences the permeability μ accordingly, so that the latter also changes over the length of the soft magnetic strip material 40 that has been produced from the tape-shaped material 39.

In a tape production method, it can thus be provided, for example, that the tape material be unwound from a magazine and pulled through a tubular heat treatment furnace and be placed under tensile stress along the longitudinal axis of the tape. At annealing temperatures above the crystallization point, the initially amorphous material in the heat treatment zone can pass into a nanocrystalline state that in this case is responsible for the outstanding soft magnetic properties of the emerging tape (strip material). The prevailing tensile stress causes transverse anisotropy in the magnetic material so that the emerging soft magnetic tape (strip material) has an exceptionally flat hysteresis loop with permeability μ with a narrow tolerance (in the range from 10,000 to below 100 in the measurement direction along the tape axis). Here, the attainable level of the permeability μ or the induced anisotropy $K_u$ is proportional to the applied tensile stress in the tape. These relationships are illustrated in FIGS. 17 and 18 for the nanocrystalline alloy VP800 of the vacuum melt.

Subsequently, the tape strip that is, for example, at this point no longer under tensile stress is routed through the measurement arrangement 33 that in real time measures the permeability μ (and optionally still other quantities, such as, for example, the tape cross-section, coercive field, remanence ratio, losses, etc.). With the knowledge of these values, at the end of the process, the continuously running tape is processed into an annular tape-wound core in which a certain length of the magnetic tape is always unwound onto a winding mandrel.

With the described technology, therefore, soft magnetic tape material with the most varied permeability levels with extremely small deviations from the setpoint permeability value over the entire tape length can be produced, the permeability being allowed to rise or fall in a dedicated manner over certain tape length ranges in order to essentially continuously adjust, as mentioned above, a desired radially-variable permeability characteristic along the tape for each core type. Using the measurement arrangement that is necessary for the control process, information about the magnetic tape cross-section (local $A_{Fe}$ of the tape) can also be continuously obtained. If controlled permeability and information about the tape cross-section are combined and placed at the end of a core winding process, annular tape-wound cores with a given permeability characteristic and very low specimen dispersions with respect to the $A_{Fe}$ value of the core are obtained.

The diagram that is shown in FIG. 21 illustrates, for example, how the core permeability can be controlled by variation of the permeability over the running length. A core 30 mm high and 60 mm in average diameter is assumed here. The permeability on the inner periphery is 100 and on the outer periphery is 200 so that an average permeability $\mu_m$ of 150 results. Here, the respective (matched) permeability μ over the tape length is given. In this case, the tensile stress is controlled such that the permeability μ rises over the length of roughly 90 m that is required for one core. When the 90-meter mark is reached, the permeability of μ=200 is set back as quickly as possible to μ=100 so that the control process for the next core can start anew.

FIG. 22 shows the magnetization J over the magnetic field intensity A for different annular tape-wound cores of nanocrystalline material with tensile-stress-induced anisotropy for a permeability range of μ=2000 to 60.

FIG. 23 shows in three views a wound annular core 38 of tape material with a permeability that rises over the length.

In one development that is shown in FIG. 24, a powder core part 39*a* with, for example, a homogeneous permeability distribution is used onto which then tape material with a permeability value that rises over the length is wound, yielding a wound core part 39*b*.

FIG. 25 schematically shows a type of control of the permeability that is alternative to the procedure shown in FIG. 21. Here, after reaching the upper permeability value of 200, there is no retreat to the initial value of 100 as promptly as possible, but with the quantitatively same flank steepness as in the rise, the permeability drops back from 200 to 100; after the value of 100 is reached, in turn it rises from 100 to 200. Thus, the losses that occur when retreating from the upper permeability value to the lower permeability value as in the procedure according to FIG. 21 are avoided.

In any case then, an altered winding technique is necessary. The altered winding technique necessary for this purpose is schematically explained in FIG. 26, its being distinguished between the rising flank and the falling flank, i.e., between the rising permeability value and the falling permeability value over the tape length. In each case, at the inversion points of the permeability by means of a switch 43, therefore the tape is routed on a path 1 for the subsequently rising permeability and on a path 2 for subsequently falling permeability. In the path 1, winding takes place as in the case shown in FIG. 19 directly, while for path 2, it is wound via an intermediate storage, for example a roller magazine, and is guided from there only to the actual core winding site, for example another core winding site 2.

Within the scope of one embodiment, FIG. 27 shows comparison measurements between a gradient core and a core with constant permeability (μ=1000) each with the dimensions 13 mm×25 min (inside diameter×outside diameter) and a core height of 6.1 mm. In this core with an outside-to-inside diameter ratio of barely 2, the geometrically-induced discharge effect into magnetic saturation can be very nicely observed (curve 47). In particular, the idealized hysteresis curve 45 on the tape strip is shown. The curve 47 shows the measurement on the core with constant permeability, and curve 46 shows the measurement for the gradient core. The curve 45 due to three-dimensional matching of the permeability approaches the hysteresis curve on the tape strip (curve 54). In the partial FIG. 27*a* that belongs to the curve 47, it can be recognized that the permeability has been kept constant over the 17 meters of tape material that are necessary for the core. In contrast, partial FIG. 27*b* shows that the permeability has been increased from 700 to roughly 1400 over 14 meters of tape material in a special form in order to achieve three-dimensional matching of the permeability to the core that as a result yields the hysteresis curve 46.

For the embodiment that was explained above in conjunction with FIG. 27, FIG. 28 shows in a diagram the actual (therefore measured) characteristic of the permeability (45*b*, x-measurement points) and the precalculated characteristic (theoretical characteristic 46*a*) of the permeability along the tape that is necessary for a core. During the continuous annealing process, the tensile stress in the tape material was changed using the precalculated "theoretical" characteristic of the permeability such that the rise of the permeability that is shown in FIG. 28 (measurement points 46*b*) occurs.

Optimized amorphous and nanocrystalline gradient tape-wound cores at large saturation flux and at the same time very exactly adjustable permeability develop a comparatively large permeability range. This makes them usable for the most varied applications. For storage inductors, thus in particular permeability values distinctly above roughly 100 also become accessible; this opens up new possibilities for building inductors with comparatively smaller numbers of turns in order to reduce copper losses. For highly linear DC voltage-tolerant current converters, the permeability range from several 100 to a few 1000 is of interest since the tapes that have been heat-treated under tensile stress, independently of the degree of saturation, have an almost constant permeability up to saturation (μ(H)=constant), and this property can also be obtained for the complete core (compare FIG. 9).

First Application Example

Annular Tape-Wound Core-Inductor

The tape permeability of an amorphous or nanocrystalline tape that has been heat-treated under tensile stress in a good approximation behaves in a staggered manner over the degree of saturation, i.e., there is an essentially linear B(H) curve up to saturation, according to a permeability that is constant up to saturation and that then drops extremely dramatically (compare FIG. 6). A core wound from this material with constant permeability with typical dimensions shows a $L(I_{DC})$ characteristic with a broadly smeared falling shoulder on the saturation boundary (compare FIG. 7). Accordingly, the effective B(H) curve of the core shows a notable rounding in the transition into saturation (compare FIG. 8). If, conversely, a radially rising permeability profile is chosen, i.e., μ(r)=a*r (with a*=constant), in the boundary case of optimal matching, the original tape characteristic can also be retained for the complete core. Furthermore, only the permeability value and thus the inductance value remain at a uniform maximum value up to saturation. If this sharp transition should not be desired, intermediate states that deviate from the optimum can also be set in a dedicated manner.

Second Application Example

Powder Core Inductor

The permeability of powder cores for different, typical initial permeabilities (permeabilities on the inside diameter) behave like the characteristics that are shown in FIGS. 15 and 16. FIG. 16 shows an $L(I_{DC})$ characteristic for a core with typical dimensions and of typical material compared to a core of the same dimension and same material composed of two concentric rings. Here, optimization with respect to the $L(I_{DC})$ characteristic can also be achieved.

Primarily wound, rotationally symmetric annular tape-wound cores will relate to the main application for the core optimization described here since they require comparatively simple three-dimensional matching of the core permeability with comparatively moderate permeability changes along the tape running length. A use of the method is also conceivable, however, for U cores, I cores, and cores of another shape, the permeability variation along the tape running lengths then having to take place on far shorter distances in order to compensate for field intensity inhomogeneities on the inner corners.

The prospects for producing tape material that has been heat-treated under tensile stress with extremely low permeabilities (permeability values around and less than 50) are limited. Conversely, above $\mu_i$=90 or 160, there is more suitable powder material. Therefore, it could be useful to use combined tape-wound and powder annular cores, therefore with an inner low-permeable powder core and an outer, more highly permeable tape-wound core matched nonradially to the permeability, as shown, for example, in FIG. 24. Tape-wound cores can be wound in single-turn inductors directly on a stack-shaped copper conductor and then can be fixed by, for example, peripheral molding or by a trough that has been pushed over and that is to be cast.

The following materials can be regarded as suitable core materials for this process: amorphous cobalt-based, nickel-based, iron-based alloys [sic] that, for example, all Vitrovac, Vitroperm allows or else all iron-based alloys with the following composition range:

$Fe_{100-a-b-c-d-x-y-z}Cu_aNb_bM_cT_dSi_xB_yZ_z$ with 10≤x<18 atom %; 5≤y<11 atom %; 0≤a<1.5 atom %; 0≤b<4 atom %

M stands for the elements: Mo, Ta or Zr with 0≤(b+c)<4 atom %

T stands for the elements: V, Mn, Cr, Co or Ni with 0≤d<5 atom %

Z stands for the elements: C, P, or Ge with 0≤z<2 atom %.

The invention claimed is:

1. A soft magnetic core, comprising at least a first portion having a first magnetic permeability and a second portion having a second magnetic permeability which is different from said first magnetic permeability and wherein a ratio of said first magnetic permeability to said second magnetic permeability is 1:1.1 or greater, and wherein said core comprises a soft magnetic tape and wherein said soft magnetic tape has a length and wherein a magnetic permeability of said tape increases over said length as said tape is radially wound from an interior of said core outwardly so that said magnetic permeability of said core increases in a radial direction moving outward from said interior of said core.

2. The soft magnetic core according to claim 1, wherein said core has an annular shape.

3. The soft magnetic core according to claim 1, wherein said core comprises at least two different soft magnetic elements each having a different magnetic permeability compared to the other that are joined to one another.

4. The soft magnetic core according to claim 3, wherein one of said soft magnetic elements has an inherently non-homogeneous magnetic permeability distribution and said other of said elements has a radially changing magnetic permeability.

5. The soft magnetic core according to claim 3, wherein at least one of said soft magnetic elements comprises one or more tapes.

6. The soft magnetic core according to claim 1, comprising a one-piece powder core element.

* * * * *